US005515574A

United States Patent [19]

Larson

[11] Patent Number: 5,515,574

[45] Date of Patent: May 14, 1996

[54] NONCYLINDRICAL TELESCOPING HANDLE

[75] Inventor: Timothy J. Larson, Onalaska, Wis.

[73] Assignee: Sparta Brush Co., Inc., Sparta, Wis.

[21] Appl. No.: 299,727

[22] Filed: Sep. 1, 1994

[51] Int. Cl.[6] ..... B25G 1/04

[52] U.S. Cl. ..... 16/115; 15/144.4; 403/109

[58] Field of Search ..... 16/115, 111 R; 81/177.1, 177.6, 489; 15/144.4; 403/109, 378, 377

[56] References Cited

U.S. PATENT DOCUMENTS

| | | | |
|---|---|---|---|
| 2,319,992 | 5/1943 | Hubbard . | |
| 2,595,597 | 5/1952 | Morseth | 16/115 |
| 2,606,050 | 8/1952 | Morris et al. . | |
| 2,980,456 | 4/1961 | McMullin . | |
| 3,076,263 | 2/1963 | Musto . | |
| 3,366,406 | 1/1968 | Morris . | |
| 3,913,515 | 10/1975 | Hernsjo et al. . | |
| 4,247,216 | 1/1981 | Pansini . | |
| 4,325,157 | 4/1982 | Balint et al. . | |
| 4,345,351 | 8/1982 | Moss et al. | 16/115 |
| 4,535,645 | 8/1985 | DeBisschop et al. | 403/109 |
| 4,653,142 | 3/1987 | Upton . | |
| 4,659,125 | 4/1987 | Chuan | 16/115 |
| 4,793,646 | 12/1988 | Michaud, Jr. . | |
| 4,969,231 | 11/1990 | Mader et al. | 81/177.1 |
| 5,152,627 | 10/1992 | Arnold | 403/109 |
| 5,343,587 | 9/1994 | Findley | 15/144.4 |

*Primary Examiner*—Maurina T. Rachuba
*Assistant Examiner*—Chuck Y. Mah
*Attorney, Agent, or Firm*—Wheeler & Kromholz

[57] ABSTRACT

A noncylindrical telescoping handle. Noncylindrically shaped tube members, such as ergonomically designed substantially triangular shaped tubes, are slidably engaged within one another which allow the tubes to move only in a linear relationship with respect to one another. By preventing the tubular members from rotating relative to one another, the telescoping handle can be moved and locked into a plurality of alternate positions of varying lengths. A spring-snap button is provided in the inner tubular member whereby the snap button protrudes through an aperture in the outer member when the two structures come into alignment. Furthermore, an elongated opening is provided at the end of the outer tubular member providing an emergency stop to prevent the tube members from completely separating.

6 Claims, 1 Drawing Sheet

NONCYLINDRICAL TELESCOPING HANDLE

BACKGROUND OF THE INVENTION

It is often desirable to extend the length of a standard brush handle attached to a brush to reach areas outside of the standard brush handle work zone. For example, when painting an extended handle can be used to reach areas higher than a person's reach. When working on scaffolding or a ladder, an extended handle can be used to extend a person's lateral range from each side of the scaffold or ladder. In marine operations, a telescoping handle can be used to reach a submerged surface without requiring the person to enter the water or go beneath the water's surface to perform the required brushing operations.

Many apparatuses for extending the length of a brush handle are known in the art. These devices typically have a means for receiving the brush handle and a means for gripping or holding the extended handle. Some apparatuses have a fixed length while others allow for adjustment in length. None have the unique means and features of adjustment of the present invention.

It is an object of this invention to provide a telescoping handle for receiving a brush handle of a brush that is adjustable in length. It is a further object to provide a telescoping handle having an aligned locking mechanism for easy extension and retraction of the mating telescoping handle members. It is yet a further object to provide a safety stop to prevent accidental disengagement of the mating telescoping handle members. It is yet a further object to provide a telescoping handle that is rigid and has an ergononmically designed handle that is easy to grip and use.

These and other objects and benefits of the invention will be apparent to one skilled in the art from the following description.

SUMMARY OF THE INVENTION

The present invention comprises a noncylindrical telescoping handle having a means for receiving the handle of a brush at one end and a gripping means at the other end. The telescoping handle is adjustable in length and has plurality of locked positions for adjustment to predetermine length.

At least two (2) tubular members, an inner member and an outer member, having substantially triangular cross-sections are placed one inside the other. The triangular cross-section of each member allows each to move only in a linear relationship with respect to each other. Rotational movement is prevented.

Each inner tubular member has an aperture formed therein near one end and has a snap button assembly fixedly attached within the member at that end. The snap button protrudes through the aperture. The snap button is biased in an outward direction by a spring in the assembly. One end of the spring is attached to the snap button.

Each outer tubular member has at least one aperture formed therein at a predetermined location and is sized to receive the snap button. In the preferred embodiment, a plurality of apertures are provided along the length of the outer tubular member such that the snap button can be received in any one of the plurality of apertures and the telescoping handle can be locked in any one of a plurality of lengths.

Each inner tubular member is placed within an outer tubular member. The inner tubular member is linearly extended from the outer tubular member until a snap button of the inner tubular member comes into alignment with one of the apertures along the length of the outer tubular member. At this point, the snap button, biased outwardly by the spring, protrudes through the aperture and locks the inner tubular member with the outer tubular member at a predetermined length. To extend the telescoping handle further, the snap button is depressed and the inner tubular member is extended further until the snap button comes into alignment with the next aperture along the length of the outer tubular member. To retract the telescoping handle, the snap button is depressed so that the inner tubular member can be retracted into the outer tubular member.

Because rotation of the tubular members relative to one another is prevented due to their substantially triangular cross-sections, the snap button located within the inner tubular member will always come into positive alignment with the apertures of the outer tubular members. By preventing the tubular members from rotating relative to one another, the telescoping handle can be moved into a plurality of alternate positions of varying lengths without having to pay attention to the rotational alignment of the tubular members. The snap button will always come into perfect alignment with the selected outer member aperture.

In addition to providing the outer tubular members with a plurality of apertures for locking the tubular members at varying lengths, a plurality of tubular members can be placed one inside another so that a multi-section telescoping handle is formed having even greater lengths when fully extended.

Near the end of each outer tubular member where the inner tubular member extends from, an elongated aperture or opening is providing to act as a safety catch. The elongated aperture prevents the accidental complete disengagement of the tubular members. The elongated aperture is shaped as such to allow a greater amount of time (and a considerably larger degree of certainty) for the spring button of the inner member to extend to an engagement position when the inner member is moved in a rapid linear relation to the outer member.

A handle grip is provided at the handle end of the outermost tubular member. The handle grip slides over the exterior of the end of the outermost tubular member, opposite the end where the inner tubular member extends from. The handle grip has the same triangular cross-section which provides an ergononmically designed handle grip that is easy and comfortable to hold. The end of the outer tubular member opposite the handle grip has a collar which includes an substantially triangular opening having a smooth bearing surface. The smooth bearing surface provides a smooth sliding fit between the bearing surface and the outer surface of the inner tubular member. Similarly the inner tubular member has a guide inserted at its end which is subsequently inserted into the outer tubular member. The guide includes another bearing surface which provides a smooth sliding fit between this bearing surface and the inner surface of the outer tubular member.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
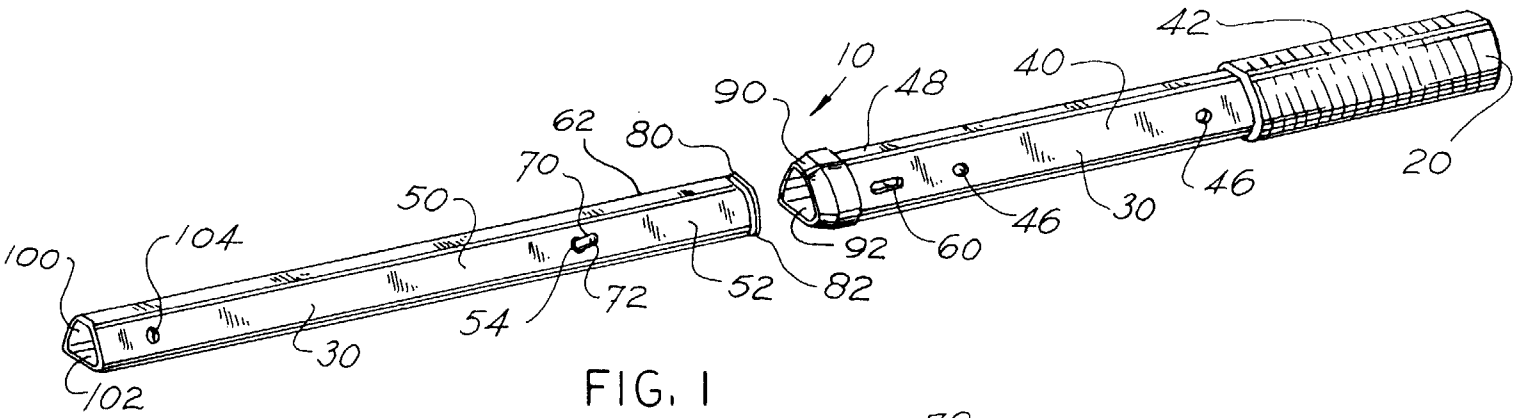
FIG. 1 is a perspective view of the present invention disassembled into its two primary components.

The invention 10, as shown in FIG. 1, comprises a noncylindrical telescoping handle having a handle grip 20, a plurality of tubular members 30, at least one spring snap button assembly 70, and a receiver 100. The handle of a brush fits snugly into opening 102 of receiver 100 forming a brush having an extendable and retractable telescoping handle. Receiver 100 also includes an aperture 104. If the brush handle has a spring-snap button assembly or similar locking device, the snap-button passes through aperture 104 to securely lock the brush handle into receiver 100. Also, an additional tubular member or set of telescoping tubular members can be inserted into receiver 100 for further extending the noncylindrical telescoping handle 100. In the latter case, aperture 104 is utilized to receive the snap button of the additional tubular member or members.

A handle grip 20 molded from rubber or another suitably soft and pliable material is located at end 42 of outer tubular member 40. Grip 20 has a substantially triangular cross-section.

Figure 5:
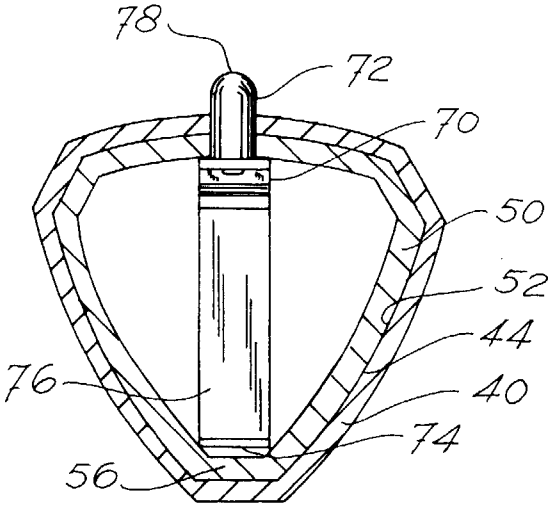
FIG. 5 is cross-sectional view of the inner and outer tubular members in slidable engagement including the spring snap button assembly taken on line 5—5 of FIG. 4.
Figure 3:
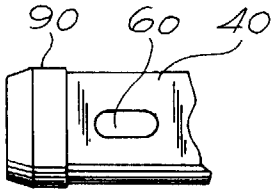
FIG. 3 is a partial front view of an end of the outer tubular member including the elongated safety catch slot and collar.
Figure 2:
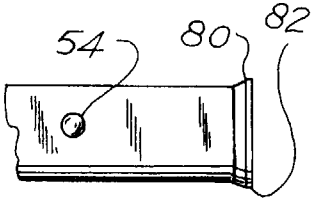
FIG. 2 is a partial front view of an end of the inner tubular member including the spring snap button and guide.

Tubular members 30 have a substantially triangular cross-section as shown in FIGS. 1 and 5. Each member 30 is made from aluminum and has a wall thickness of 0.050 inches (0.127 cm).

Figure 4:
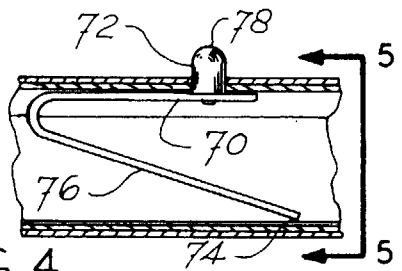
FIG. 4 is a partial cutaway view of the inner and outer tubular members in slidable engagement including the spring snap button assembly.

As shown in FIG. 5, within outer tubular member 40 an inner tubular member 50 is slidably engaged. Inner tubular member 50 has an outer surface 52 that slidably engages with inner surface 44 of outer tubular member 40. An aperture 54 is formed within inner tubular member 50 near end 62. Spring-snap button assembly comprises a spring-snap button 72 and a spring 76. Button 72 is attached to spring 76 as shown in FIG. 4. Spring-snap button 72 of spring-snap button assembly 70 protrudes through aperture 54. Button assembly 70 is permanently positioned within inner tubular member 50 as shown in FIGS. 4 and 5. The base 74 of the button spring 76 rests against the apex 56 of inner member 50. Spring 76 biases button 72 in an outward direction.

Outer tubular member 40 has a plurality of similar apertures 46 along its length for receiving spring-snap button 72. Near end 48, opposite end 42, an elongated opening or slot 60 is formed. Slot 60 acts as a safety catch to prevent inner tubular member 50 from completely separating from outer tubular member 40. When inner tubular member 50 is extended to its outermost position and the user depresses spring-snap button 72, if the inner member 50 is pulled forward by mistake instead of being retracted, spring-snap button 72 will catch in slot 60 before outer member 40 and inner member 50 are separated. Thus, slot 60 acts as a safety mechanism for ensuring that the two members 50 and 60 remain integral.

A guide collar 90 having an inner bearing surface 92 is located at end 48 of outer member 40. Inner bearing surface 92 helps outer surface 52 of inner member 50 to smoothly slide when length adjustments are made to the noncylindrical telescoping handle 10. Additionally, inner tubular member 50 has an internal guide 80 located at end 62. Internal guide 80 has a bearing surface 82 which smoothly slides along inner surface 44 of outer tubular member 40. Both guide collar 90 and internal guide 80 add to the stability of telescoping handle 10.

Receiver 100 is designed to hold an insert if the cross-section of the brush handle to be extended is not substantially triangular. For example if the brush handle is round, and insert having a round opening for receiving the brush handle and a substantially triangular exterior is inserted into receiver opening 102.

To operate the noncylindrical telescoping handle 10, the user simply depresses the spring-snap button 72 inward toward outer tubular member 40. The concave surface 78 of button 72 facilitates the movement of the tubular members 30 relative to one another. Even though button 72 is not completely depressed through and below aperture 46, concave surface 80 forces snap button 72 below outer tubular member 40 so that tubular members 40 and 50 can be moved relative to each other. Concave surface 78 also allows snap button 72 to easily slide along inner surface 44 of outer member 40 and to easily project back through one of the apertures 46 when the selected length is reached.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed

1. A noncylindrical telescoping handle for a brush, the handle comprising:

a first tubular member having a substantially triangular cross-section;

a second tubular member having a substantially triangular cross-section;

a snap-spring button attached to an end of a spring;

the second tubular member slidably engaged within the first tubular member and having at least one second member aperture;

the spring and snap-spring button located within the second tubular member, the spring biasing the button through the second member aperture;

the first tubular member having at least one first member aperture in alignment with and for receiving the button;

an elongated opening near an end of the first tubular member for receiving the button;

the second tubular member having an opening on an end for receiving the brush.

2. A noncylindrical telescoping handle for a brush, the handle comprising:

a first tubular member having a substantially triangular cross-section and a smooth inner surface;

a second tubular member having a substantially triangular cross-section and a smooth outer surface;

a snap-spring button attached to an end of the spring;

the second tubular member slidably engaged within the first tubular member and having at least one second member aperture;

the spring and snap-spring button located within the second tubular member, the spring biasing the button through the second member aperture;

the first tubular member having at least one first member aperture in alignment with and for receiving the button;

a guide being located on one end of the second tubular member, the guide having a bearing surface for sliding along the smooth inner surface of the first tubular member;

the second tubular member having an opening on an end for receiving the brush.

3. The noncylindrical telescoping handle of claim 2 further including a collar located on one end of the first tubular member, the collar having an opening, the opening having a bearing surface for sliding along the smooth outer surface of the second tubular member.

4. A noncylindrical telescoping handle for extending the length of a brush handle, the telescoping handle comprising:

a first and a second tubular member, each member having ends and a substantially triangular cross-section;

the first member slidably engaged within the second member and having a first member aperture at one end;

a spring located within the first member and having a snap-button attached thereto, the spring biasing the snap button through the first member aperture;

the second member having at least one second member aperture in alignment with and for receiving the snap button;

the first member having a receiving means for receiving the brush handle;

the second member having a grip on one end for gripping the noncylindrical telescoping handle;

the first tubular member including a guide attached at one end and the second tubular member including a collar attached at one end;

the first tubular member having a smooth outer surface and the second tubular member having a smooth inner surface;

the guide having a bearing surface slidably engaged with the smooth inner surface of the second tubular member; and the collar having a bearing surface slidably engaged with the smooth outer surface of the first tubular member.

5. A noncylindrical telescoping handle for extending the length of a brush handle, the telescoping handle comprising:

a first and a second tubular member, each member having ends and a substantially triangular cross-section;

the first member slidably engaged within the second member and having a first member aperture at one end;

a spring located within the first member and having a snap-button attached thereto, the spring biasing the snap button through the first member aperture;

the second member having at least one second member aperture in alignment with and for receiving the snap button;

the first member having a receiving means for receiving the brush handle;

the second member having a grip on one end for gripping the noncylindrical telescoping handle;

the second tubular member including an elongated opening near an end of the second tubular member for receiving the snap button.

6. A telescoping brush handle for extending the handle of a brush, the telescoping brush handle comprising:

at least two tubular members having substantially triangular cross-sections slidably engaged within one another defining an inner member and an outer member;

the inner member having a spring located therein, a snap button attached to the spring, the spring biasing the snap button outwardly through an aperture formed in the inner member;

the outer member having at least one outer member aperture in alignment with the snap button for receiving the snap button therethrough;

the inner member having a receiving means for receiving the brush handle;

an elongated opening near an end of the outer tubular member for receiving the snap button.

* * * * *